United States Patent [19]

Hoffmüller

[11] 4,383,809

[45] May 17, 1983

[54] CAPSULE FOR USE IN HOT ISOSTATIC PRESSING OF WORKPIECES

[75] Inventor: Wilhelm Hoffmüller, Munich, Fed. Rep. of Germany

[73] Assignee: Motoren-und Turbinen-Union Munchen GmbH, Munich, Fed. Rep. of Germany

[21] Appl. No.: 240,643

[22] Filed: Mar. 5, 1981

[30] Foreign Application Priority Data

Mar. 18, 1980 [DE] Fed. Rep. of Germany ..... 3010299

[51] Int. Cl.[3] ..... B30B 11/00; B22F 3/12

[52] U.S. Cl. ..... 425/78; 425/405 H

[58] Field of Search ..... 425/405 H, 78

[56] References Cited

U.S. PATENT DOCUMENTS

| | | | |
|---|---|---|---|
| 3,559,236 | 2/1971 | Merritt | 425/405 H X |
| 4,008,023 | 2/1977 | Wentzell | 425/78 |
| 4,142,888 | 3/1979 | Rozmus | 425/405 H X |
| 4,216,017 | 8/1980 | Carcey | 425/78 X |
| 4,217,089 | 8/1980 | Bowes | 425/405 H X |

FOREIGN PATENT DOCUMENTS

| | | | |
|---|---|---|---|
| 2101860 | 8/1971 | Fed. Rep. of Germany | 425/405 H |

*Primary Examiner*—J. Howard Flint, Jr.

*Attorney, Agent, or Firm*—Alan H. Levine

[57] ABSTRACT

A capsule for use in hot isostatic pressing of a complex-shape workpiece, comprising a ceramic core formed with a cavity having the negative contour of the workpiece, the cavity being open on one side of the core. A metal skin encloses the core, the skin being spaced from the side of the core having the cavity opening and snugly fitting all the remaining sides of the core. The skin has a port through which metal powder can be introduced into the cavity and the space between the skin and core. Where the capsule is used to make a turbomachine rotor having centrifugal blading, the spacing between the skin and core side corresponds to the thickness of the rotor disk. The manufacturing method includes inserting blades of sheet metal into the blade matrices of the cavity, followed by filling the remainder of the cavity with metal powder and then isostatically hot pressing the powder.

3 Claims, 3 Drawing Figures

CAPSULE FOR USE IN HOT ISOSTATIC PRESSING OF WORKPIECES

This invention relates to a capsule for hot isostatic pressing (H.I.P.) of turbomachine components of complex shapes which are subjected to high stresses.

It has been impossible in the past to use the hot isostatic pressing process for manufacturing complex-shape workpieces, such as bladed turbomachine rotors, in their final contour, because the manufacture of pressing capsules or cans exhibiting negative contours to match such workpieces is impracticable.

It has admittedly been attempted to manufacture such intricately shaped cans by an electrochemical discharge process, but sufficiently good results were not achieved despite the attendant high cost of manufacture. It has been found instead that the pressings invariably require finishing, which again requires a tremendous effort considering the material properties of hot isostatically pressed workpieces.

It is a broad object of the present invention to provide a capsule of this general category which permits hot isostatic pressing of workpieces of the most complex shapes, and which is so true to form that after hot isostatic pressing the workpieces so manufactured require little if any finishing. Additionally, the effort expended in the manufacture of the capsule itself is minimized.

It is a more particular object of the present invention to provide an arrangement wherein a ceramic core, open on one side and exhibiting the negative contour of the workpiece, is enclosed by an outer metal skin which, while being spaced from the ceramic core on its open side, snugly fits the core on its remaining sides.

The prime advantage provided by a capsule according to the present invention is that the ceramic core will not change its form during H.I.P., so that the only change to the form of the powder-filled capsule is on the open side of the ceramic core. The most complex of contours, when formed in the ceramic core, will automatically yield an accurately formed shape, while the high pressures can still be transmitted to the powder via the open side of the ceramic core. The pressures are transferred through the outer metal skin, which is easy to close off by welding or soldering. As the pressure transfer medium in hot pressing, use is preferably made of argon. After pressing, the finished workpiece is exposed by first removing the outer skin and next the ceramic core, the latter being preferably removed mechanically, although chemical removal of the ceramic core is also feasible.

According to an advantageous feature of the present invention, a capsule according to the invention can be used for the manufacture of a turbomachine rotor having centrifugal blading, in which case the ceramic core exhibits the negative contour of the blade-end hub and of the blading. The manufacture of such turbomachine rotors, which are normally made of titanium or titanium-base alloys, is considerably facilitated by a capsule designed in accordance with the present invention, where the process temperature during hot pressing range from 950° C. to 1000° C., and the pressures from 1500 bars to 3000 bars. Upon pressing in a capsule according to the present invention, and after removal of the capsule, the turbomachine rotor will be finished, although finishing here involves only the hub surface pointing away from the blading.

The present invention further relates to a method for hot isostatic pressing of turbomachine rotors, especially of centrifugal rotors, with a capsule as described above. The method is characterized by premanufactured blades of sheet material being inserted into the molds of the ceramic core, after which the remaining cavity of the capsule is filled with metal powder and the capsule is then closed and isostatically hot pressed. This method provides an advantage over conventional hot pressing processes, in which the entire workpiece is homogeneously pressed out of powder, in that the premanufactured blades can be made of a material different from that of the rotor hub, which in some applications may improve the service properties of the rotor.

An illustrative embodiment of a capsule, according to the present invention, for hot isostatic pressing is described more fully with reference to the accompanying drawings, in which.

Figure 1:
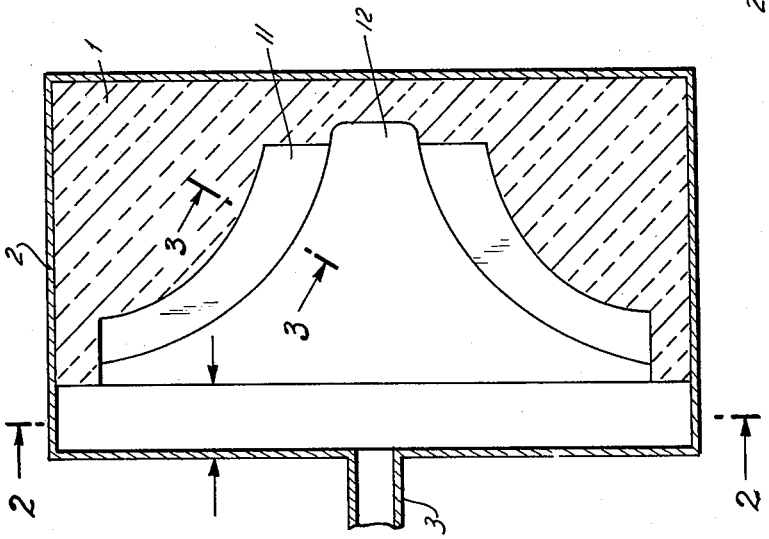
FIG. 1 is a longitudinal cross-sectional view of a capsule.

With reference to FIG. 1, the H.I.P. capsule shown in longitudinal cross-section comprises a ceramic core 1 exhibiting the negative contour of a centrifugal turbine wheel having a hub area 12 and blade matrices 11, the upper side of the ceramic core being exposed. The ceramic core 1 is enclosed by an outer metal skin 2 which, while snugly fitting the bottom surface and side surfaces of the ceramic core, leaves a spacing "A" between itself and the upper side of the ceramic core 1. This will be necessary to allow for the reduction in volume of the powder which takes place during the pressing process. The distance "A" is accurately selected to suit the degree of compaction intended, and preferably corresponds to the thickness of the disk of the turbine wheel being produced. On the upper side of the outer metal skin 2, a filler port 3 is provided centrally to accept the powder material to be pressed. This port is sealed to contain the pressure produced during the pressing process.

Figure 2:
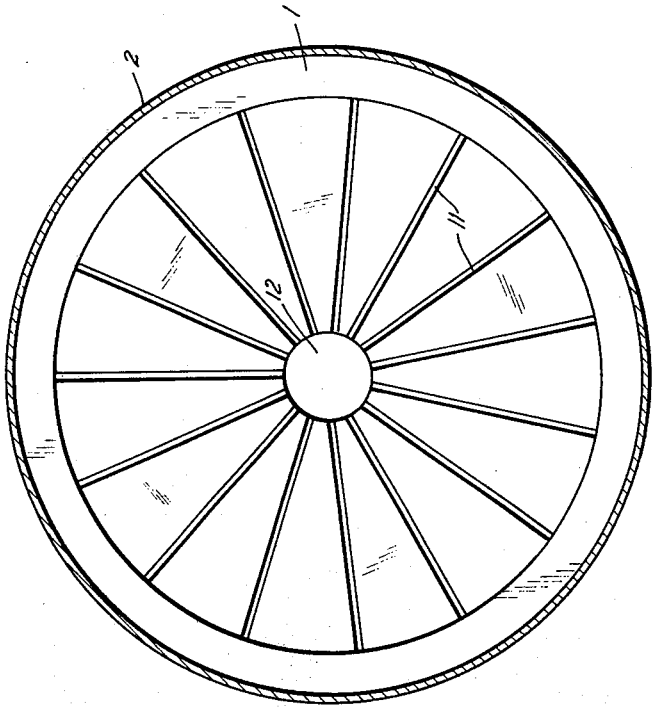
FIG. 2 is a cross-sectional view of the capsule taken along line 2—2 of FIG. 1.

In the cross-sectional view of FIG. 2, the blade matrices 11 of the ceramic core 1 are shown as straight-line gaps, which are used for the manufacture of a rotor having straight blades. These straight gaps can be replaced by curved gaps for the manufacture of curved rotor blades.

Figure 3:
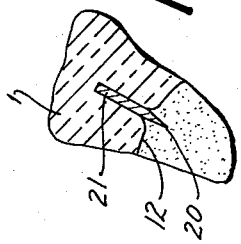
FIG. 3 is a fragmentary cross-sectional view taken along line 3—3 of FIG. 1.

The fragmentary cross-sectional view of FIG. 3 serves to illustrate an alternative manufacturing method for producing a turbomachine rotor. According to this method, premanufactured blades of sheet material, such as of a suitable metal, one of which is shown in sectional view and indicated by the numeral 21, are inserted into the blade matrices of the ceramic core 1, after which the remaining portion of the capsule cavity, especially the hub area 12, is filled with metal power. To insure a good joint between the premanufactured blade sheet 21 and the powder metal hub 12 of the turbomachine rotor, the blade 21 is given a conical taper at its root 20.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A capsule for use in hot isostatic pressing of a complex-shape workpiece, comprising:

a ceramic core formed with a cavity having the negative contour of the workpiece, the cavity being open on one side of the core, and a metal skin enclosing the core, the skin being spaced from the side of the core having the cavity opening and snugly fitting all the remaining sides of the core.

2. A capsule as defined in claim 1 wherein the skin has a port through which powder can be introduced into the cavity and the space between the skin and the side of the core having the cavity opening.

3. A capsule as defined in claim 1 wherein the capsule is used to make a turbomachine rotor having centrifugal blading, the negative contour of the cavity corresponding to the blade-end rotor hub and the blades, and the spacing between the skin and the side of the core having the cavity opening corresponding to the thickness of the disk of the turbomachine rotor.

* * * * *